US010232919B2

(12) United States Patent
Chitwood et al.

(10) Patent No.: US 10,232,919 B2
(45) Date of Patent: Mar. 19, 2019

(54) MULTI-VESSEL PROCESS TO INSTALL AND RECOVER SUBSEA EQUIPMENT PACKAGES

(71) Applicant: Safe Marine Transfer, LLC, Houston, TX (US)

(72) Inventors: James E. Chitwood, Spring, TX (US); Art J. Schroeder, Jr., Houston, TX (US); Jason C. Mailand, Houston, TX (US); Timothy T. Krasin, Houston, TX (US)

(73) Assignee: Safe Marine Transfer, LLC, Houston, TX (US)

( * ) Notice: Subject to any disclaimer, the term of this patent is extended or adjusted under 35 U.S.C. 154(b) by 0 days.

(21) Appl. No.: 14/837,387

(22) Filed: Aug. 27, 2015

(65) Prior Publication Data

US 2016/0059943 A1 Mar. 3, 2016

Related U.S. Application Data

(60) Provisional application No. 62/042,565, filed on Aug. 27, 2014.

(51) Int. Cl.

| | |
|---|---|
| ***B63C 7/12*** | (2006.01) |
| ***B63B 21/50*** | (2006.01) |
| ***B63B 27/08*** | (2006.01) |
| ***B63B 27/36*** | (2006.01) |
| ***B63B 35/28*** | (2006.01) |

(Continued)

(52) U.S. Cl.

CPC ..... *B63C 7/12* (2013.01); *B63B 21/50* (2013.01); *B63B 27/08* (2013.01); *B63B 27/36* (2013.01); *B63B 35/28* (2013.01); *B63B 43/06* (2013.01); *B63C 7/02* (2013.01); *B63C 7/16* (2013.01); *E02D 23/08* (2013.01); *B63B 2021/505* (2013.01)

(58) Field of Classification Search

CPC combination set(s) only.
See application file for complete search history.

(56) References Cited

U.S. PATENT DOCUMENTS

| | | | |
|---|---|---|---|
| 3,987,638 | A | 10/1976 | Burkhardt et al. |
| 4,007,700 | A | 2/1977 | Haynes et al. |

(Continued)

FOREIGN PATENT DOCUMENTS

| | | | |
|---|---|---|---|
| GB | 2205123 | A | 11/1988 |
| WO | 2009094739 | A1 | 8/2009 |

(Continued)

OTHER PUBLICATIONS

International Search Report and Written Opinion dated Jan. 14, 2016 in corresponding application No. PCT/US2015/047094 (12 pages).

(Continued)

*Primary Examiner* — Kyle Armstrong
(74) *Attorney, Agent, or Firm* — Osha Liang LLP

(57) ABSTRACT

According to one or more embodiments disclosed herein is a method of transporting equipment between sea-surface and seafloor by providing a structure with a subsea equipment package mounted thereon. The structure is used for installation and recovery in a subsea environment by changing the buoyancy of the structure or ballasting the structure to effect a controlled sinking motion.

28 Claims, 4 Drawing Sheets

(51) Int. Cl.

| | |
|---|---|
| ***B63B 43/06*** | (2006.01) |
| ***E02D 23/08*** | (2006.01) |
| ***B63C 7/02*** | (2006.01) |
| ***B63C 7/16*** | (2006.01) |

(56) References Cited

U.S. PATENT DOCUMENTS

| | | | | |
|---|---|---|---|---|
| 4,141,377 | A | 2/1979 | Fernandez et al. | |
| 4,377,354 | A * | 3/1983 | Morton | F16L 1/165 405/158 |
| 5,215,410 | A | 6/1993 | Karal | |
| 5,224,962 | A | 7/1993 | Karal et al. | |
| 6,682,266 | B2 * | 1/2004 | Karal | B63B 21/502 114/264 |
| 7,954,658 | B2 * | 6/2011 | de Mattos | B63B 27/08 212/270 |
| 9,079,639 | B2 | 7/2015 | Chitwood | |
| 2009/0194013 | A1 | 8/2009 | Mattos | |
| 2009/0232605 | A1 * | 9/2009 | Breivik | E21B 19/002 405/203 |
| 2014/0341657 | A1 | 11/2014 | Chitwood et al. | |
| 2015/0345275 | A1 * | 12/2015 | Sathananthan | E21B 36/00 210/737 |

FOREIGN PATENT DOCUMENTS

| | | | | |
|---|---|---|---|---|
| WO | WO-2010046686 | A2 * | 4/2010 | B63B 27/00 |
| WO | WO-2010144187 | A1 * | 12/2010 | B01D 17/0208 |
| WO | 2013150079 | A1 | 10/2013 | |

OTHER PUBLICATIONS

Den Boer, A.S. et al., "An Integrated Towed Flowline Bundle Production System for Subsea Developments" Technology Conference, OTC 6430, pp. 85-94 (10 pages).

* cited by examiner

MULTI-VESSEL PROCESS TO INSTALL AND RECOVER SUBSEA EQUIPMENT PACKAGES

CROSS-REFERENCE TO RELATED APPLICATIONS

This application claims the benefit, pursuant to 35 U.S.C. § 119(e), of U.S. Provisional Application 62/042,565 filed on Aug. 27, 2014. This provisional application is herein incorporated by reference in its entirety.

FIELD OF THE DISCLOSURE

Embodiments disclosed herein relate generally to the lowering and installation and/or recovery of large surface area and significant mass objects to the seafloor using a plurality of tugs, anchor handling vessels or other cost efficient vessels. Such objects, for example, may be parts or components of a seafloor based facility or the facility itself.

BACKGROUND

When large surface area objects are submerged to any depth, they experience large drag forces acting much like a massive sea anchor when the supporting surface vessel responds to the sea environment. Any supporting cable from the surface vessel will experience significant amplification of the static load due to the surface vessel's motion.

Further, the vessel(s), cable and submerged object forms a "spring-mass-damper" system having a natural period that may be excited by the sea forcing motion of the surface vessels at the system's natural frequency. This creates a zone of resonance where the cable length tunes the system's natural frequency to that of the supporting vessel motion.

SUMMARY OF THE CLAIMED EMBODIMENTS

The present disclosure will describe a multi-vessel method that adequately manages the lowering and/or recovery of large surface area and high mass objects to the seafloor.

In one aspect, embodiments disclosed herein relate to a process for lowering a subsea equipment package to the seafloor. Initially, a plurality of vessels are attached the subsea equipment package via cable to individual landing points on the subsea equipment package. The vessels pay out a predetermined amount the cables. The buoyancy of the subsea equipment package is adjusted to sink the subsea equipment package. The position of the subsea equipment package is controlled as the subsea equipment package sinks toward a sea floor, where the subsea equipment package is landed and installed on the sea floor.

Adjusting the buoyancy of the subsea equipment package may be performed in one of several ways, including, ballasting the subsea equipment package, de-ballasting the subsea equipment package, removing buoyancy from the subsea equipment package, launching the subsea equipment package from a support vessel; or adding a weighted line to apply a downward force to the subsea equipment package.

After installation, the subsea equipment package may be recovered via a process including, paying out a predetermined amount the cables from the plurality of vessels, re-attaching a plurality of vessels via cable to corresponding landing points of the subsea equipment package, increasing tension in the cables and/or increasing the buoyancy of the subsea equipment package to lift the subsea equipment package off the sea floor, de-ballasting the subsea equipment package, and reeling in the cable from the plurality of surface vessels.

Other aspects and advantages will be apparent from the following description and the appended claims.

DETAILED DESCRIPTION

Figure 1:
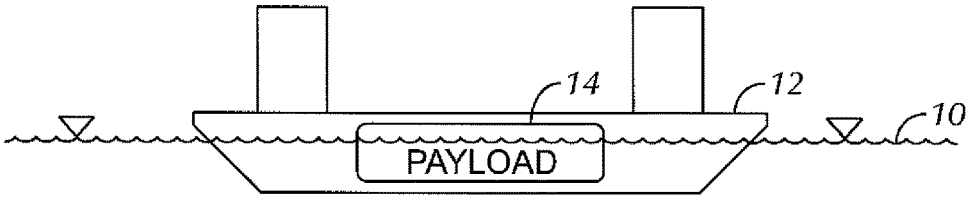
FIG. 1 is a schematic drawing illustrating portions of a method for delivering a subsea equipment package to a sea floor according to embodiments disclosed herein.

In one aspect, embodiments herein relate to a process for lowering, installation and/or recovery of large surface area and significant mass objects to the seafloor. The objects to be delivered or recovered from the seafloor may include mechanical equipment for processing of fluids, mechanical equipment for the construction services of wells, pipelines, or facilities, supplies required for the support of such mechanical equipment, tanks for storage of liquid, or any other equipment that may be useful for construction, maintenance, or support of subsea operations. These may be referred to herein as payloads, packages, objects, equipment, subsea equipment, or any combination thereof. The deployment of such equipment may be temporary or semi-permanent depending upon the payload and its function on the seafloor Initially the subsea equipment package is towed out to sea by one or more vessels. Cable is then attached from a plurality of vessels. Two, three, or more vessels may be used. The cable is attached to individual landing points on the subsea equipment package from each vessel. A predetermined amount the cable is payed out from the plurality of vessels. Buoyancy of the subsea equipment package is adjusted to sink the subsea equipment package. The subsea equipment package is positioned into its seafloor installation location as the subsea equipment package sinks toward a sea floor. Finally, the subsea equipment package is landed on the sea floor and installed.

The buoyance of the subsea equipment package is adjusted in one of several ways. Depending on the needs of the individual installation projected the buoyancy may be adjusted by increasing the ballast of the subsea equipment package, decreasing the ballast of the subsea equipment package, removing buoyancy from the subsea equipment package, launching the subsea equipment package from a support vessel, or adding a length of weighted line to apply a downward force to the subsea equipment package.

The position of the subsea equipment package needs to be maintained during the sinking and installation of the package. The controlling of the position may be accomplished in one of several ways including adjusting a length of the cable deployed from the vessels, adjusting the position and/or thrust/propulsion of the vessels, adjusting an amount of ballast in the subsea equipment package, adjusting an amount of weighted line deployed from the vessels, or adjusting the buoyancy of the subsea equipment package.

During the sinking and installation of subsea equipment packages, the subsea equipment package maintains a net positive buoyancy or net negative buoyancy, during the sinking process. This is determined based on the needs of individual installations.

After installation of the subsea equipment package on the sea floor, it is possible to recover and reuse the cable, weight cable, buoyancy material, ballast, and the subsea equipment package.

It has been found that by paying out line, adjusting buoyancy, and controlling the position, spacing, thrust, and line tension on the subsea equipment package, one can beneficially minimize a natural frequency resonance effect during the sinking process, beneficially minimize tension on the cables (decrease a strength requirement of the cables and winches and therefore the size and expense of the vessels) during the sinking process, and/or beneficially decouple the motion of the subsea equipment package as it sinks from the motion of the vessels at the surface. In this manner, one can increase the overall system compliance to vessel motion.

When large surface area objects are submerged to any depth, they experience large drag forces acting much like a massive sea anchor when the supporting surface vessel responds to the sea environment. Any supporting cable from the surface vessel will experience significant amplification of the static load due to the surface vessel's motion. These cable loads are a function of the cable stiffness, length and amount of surface vessel vertical motion at the point of suspension. Unless, some motion compensation is provided, the dynamic amplification loads may exceed the strength of the suspension cables. It is important to note when sufficient suspension cable is deployed, the "stretch" of the cable may provide adequate passive motion compensation, which is stretch; so that the dynamic amplification of the static load remains within the strength rating of the cable. Those skilled in the art using the specific properties of a cable may calculate the required cable length to manage this dynamic load amplification without additional motion compensation equipment. Use of both active and passive motion compensation equipment is common practice today to manage dynamic loads.

Further, the vessel(s), cable and submerged object forms a "spring-mass-damper" system having a natural period that may be excited by the sea forcing motion of the surface vessels at the system's natural frequency. This creates a zone of resonance potentially detrimental to the cable where the cable length tunes the system's natural frequency to that of the supporting vessel motion. When encountered in the field, best practice is to either shorten or lengthen the cable to change the system's natural period from that of the sea driven vessel motion.

The object to be lowered to the seafloor needs to initially float or be held at the ocean surface 10. For the purpose of this description consider this object to be a barge-like structure 12 fitted with a "payload" 14 for some subsea facility or service. However, the floating object may be of any shape or configuration for the purpose of this disclosure. See FIG. 1. Further, it could be a structure carried on a workboat, a launch barge, or floating with temporary floatation devices.

Figure 2:
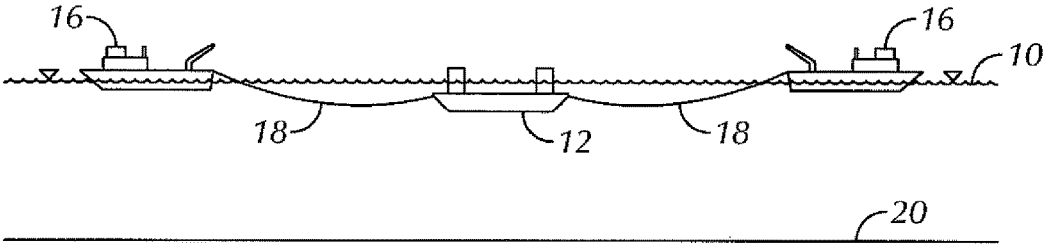
FIG. 2 is a schematic drawing illustrating portions of a method for delivering a subsea equipment package to a sea floor according to embodiments disclosed herein.

Referring now to FIG. 2, a plurality of vessels 16 (tugs or other offshore workboats), each fitted with a winch and sufficient cable 18 (wire rope or synthetic) with sufficient strength and length to execute the installation process; each attach their cable(s) to the object being installed. For the purpose of this description, two tugs will be used to illustrate the disclosure although any plurality of vessels or tugs is possible to use.

Prior to the offshore operation, an installation analysis will have been performed using the properties of the object, the connecting cables, installation sea conditions and the motion characteristics of the supporting vessel(s). The minimum required connecting cable lengths that need to be deployed to manage the dynamic amplification factor may be calculated. Note: the use of composite rope or including synthetic pendants in the supporting cable may effectively shorten the required safe cable length due to their different axial stiffness as compared to wire cable.

Figure 3:
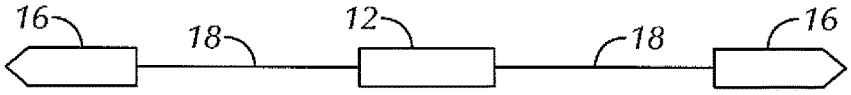
FIG. 3 is a schematic drawing illustrating portions of a method for delivering a subsea equipment package to a sea floor according to embodiments disclosed herein.

The vessels attach their lowering cables 18 to the opposite ends of the floating object 12 to be installed on the seafloor 20. Each vessel 16 pays out the required cable length while the object is maintained in the desired location. The two vessels 16 and object 12 are aligned along a common axis (180 degrees apart). Installations using multiple vessels may be equidistant arrayed around the object (such as 3 vessels at 120 degrees or 4 vessels at 90 degrees to each other). See FIG. 3. The vessels 16 will all use their propulsion to tension their respective cables 18. Object heading control and location are adjusted by the maneuvering of these vessels. At the appropriate time, the object's buoyancy is depleted until it submerges. The desired submerged weight of the object maybe managed with the use of high pressure buoyancy rated for the installation depth of the object.

Figure 4:
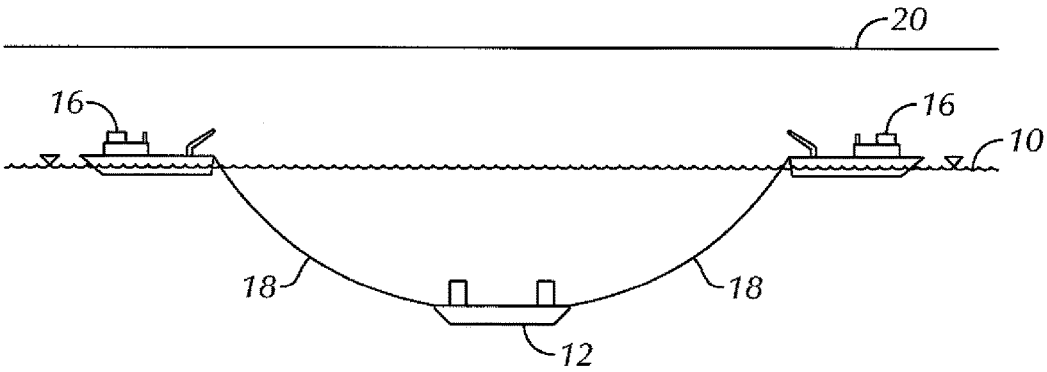
FIG. 4 is a schematic drawing illustrating portions of a method for delivering a subsea equipment package to a sea floor according to embodiments disclosed herein.

When the object becomes a negative weight in the middle of the tensioned cables, it pulls the plurality of vessels toward the object as the object sinks. At a selected safe depth, due to the calculated deployed cable length, the entire object and vessels come into an equilibrium position. The tension in the multiple supporting cables 18 support the object's submerged weight. See FIG. 4. An important feature is the inclined angle of the supporting cables 18 relative to vertical. Supporting vessel 16 motions transmitted to the submerged object 12 through the cable 16 are minimized by:

A) the sloping angle and catenary of the supporting cables;

B) the springiness of the deployed cable length;

C) varying cable tensions will tend to move the object horizontally rather than vertically due to the greater vertical forces required to generate vertical motion. Horizontal motion of the object toward one of the vessels causes the apparent length of that cable to lengthen and effectively offsets the increasing cable tension. The phasing of the varying tension in the different supporting cables contributes to this effect;

D) attaching the supporting cables at the ends or sides of the object where varying vertical cable loads will cause some rotation of the object about its center of rotation, rather than attempting to vertically move the entire object with its attendant large cable forces.

Until the safe equilibrium water depth is obtained by the object, the cable tension loads in the suspension wire ropes are not experiencing any significant tension fluctuation or amplification of the cable's static load due to the supporting surface vessel motions.

Once the submerged object is suspended in equilibrium, the supporting vessels would coordinate their location and headings as they pay out additional cable to lower the object to the desired seafloor installation location.

The use of 3 or more supporting vessels minimizes the object's freedom of motion in the horizontal plane. Motion in the horizontal dimension may be better managed with additional vessels and/or Remote Operated Vehicles (ROVs).

This installation process is reversible if the object is equipped with buoyancy tanks that can be de-ballasted. The vessels would cable lift the object from the seafloor to a submerged equilibrium point as a dead weight. Then compressed air (or gases) may be used to de-ballast tanks in the object to a slight positive buoyancy such that the object floats to the surface guided by the vessel tensioned cables. The vessels maintain the supporting cables taut as the object floats to the surface where it is secured in a safe floating condition.

The process for lowering and/or recovering an object or equipment of a large size and mass to the seafloor through the critical near surface dynamically amplified cable suspension loads is accomplished one of several ways.

The object to be lowered is initially floating on the surface of the sea using integral buoyancy, temporary buoyancy or support from a workboat or launch barge. A plurality of vessels (tugs, anchor handlers or workboats) equipped with winches and sufficient strength and length of cable are attached to the perimeter of the object being installed. Each vessel pays out a predetermined amount of cable and each vessel uses it's propulsion to tension its respective cable.

The buoyancy of the object to be installed is removed either by ballasting the object, removing any temporary buoyancy or launching the object from a workboat or barge. The object will sink under controlled conditions to an equilibrium position that is a result of the combined weight, buoyancy, suspension cable length, and support vessel thrust (propulsion). During the sinking operation, the object will be maneuvered and oriented with surface vessel heading and spacing. Finally, the object will be positioned and landed on the seafloor through coordinated vessel operations.

This method of lowering a subsea equipment package to the seafloor safely passes through the natural frequency resonance zone of the suspended cable—load system as the forcing function of the sea causes vessel motions at this natural frequency. It is possible to engineer an insignificant resonance zone by adjusting the system's design parameters.

One way to achieve this is by shifting the multiple cable suspension of the object so the entire natural frequency of this system is at a less critical water depth, possibly above the object's engineered submerged equilibrium point.

Another way to the achieve this is by adjusting the perimeter attachment of the suspension cables to the object, changing the apparent mass associated with the respective cable as a varying cable tension would induce object rotation rather than object heaving. Additionally, the longer length of suspension cable changes the spring stiffness of the entire system and thus, its natural frequency.

In another embodiment, this disclosure is related to the lowering and installation of large surface area and significant mass objects to the seafloor using a plurality of tugs, anchor handling vessels, or other cost efficient vessels. Such massive objects typically being parts or components of a seafloor based facility.

When large surface area, massive objects are submerged to any depth, they experience large drag forces acting much like a massive sea anchor when the supporting surface vessel responds to the sea environment. Any supporting cable from the surface vessel will experience significant amplification of the static load due to the surface vessel's motion. These cable loads are a function of the cable stiffness, length and amount of surface vessel vertical motion at the point of suspension. Unless, some motion compensation is provided, the dynamic amplification loads may exceed the strength of the suspension cables.

Figure 5:
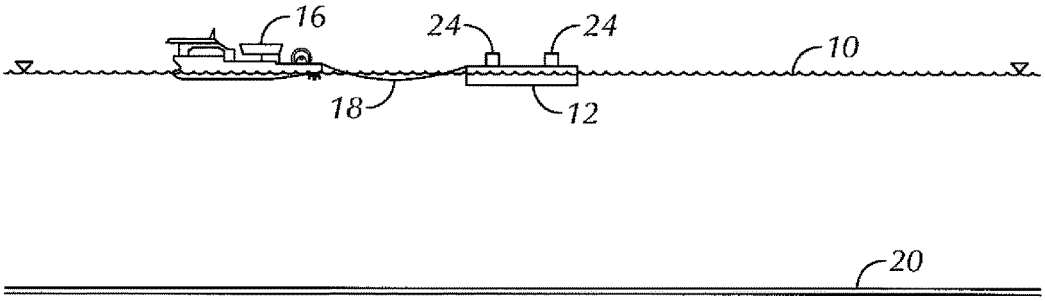
FIG. 5 is a schematic drawing illustrating portions of a method for delivering a subsea equipment package to a sea floor according to embodiments disclosed herein.

If the passive and active motion compensating systems are not sufficient or cost effective to "de-couple" the significant load from the vessel(s) motion, another type of deployment system is required. If the massive object can be made positively buoyant (i.e. float), then a plurality of heavy weight catenaries can be used to pull the massive object close to the sea floor. Once located on the seafloor, the heavy weight catenaries will not be able to completely overcome the positive buoyancy of the massive object during final placement. Once the massive object is close to the target zone, the positive buoyancy can be released (or ballasted, flooded, etc.) to land the massive object on the seafloor. Multiple heavy weight catenaries deployed from vessels a sufficient distance apart will allow for accurate object placement while damping the suspension cable natural frequency and "de-coupling" vessel motions from the massive object during the deployment. The heavy weighted catenary shape and relation to the massive object have the added benefit that they will self-regulate the massive object's rate of descent during deployment. The vessel crane loads will be limited to the weight of the down-line plus half of the weight of the heavy weighted catenaries, which will be manageable for most cost efficient vessels. Further, these motion de-coupling ballast lines have the benefit of not exciting the natural frequency of the system or having a zone of resonance The massive object 12 to be lowered to the seafloor 20 needs to initially float or be held at the ocean surface 10. For the purpose of this description consider this massive object to be a barge-like structure 12 fitted with a "payload" for some subsea facility or service. The floating object, however, may be of any shape or configuration for the purpose of this disclosure. Further, it could be a structure carried on a workboat, a launch barge 16, or floating with temporary floatation devices 24, see FIG. 5.

Figure 6:
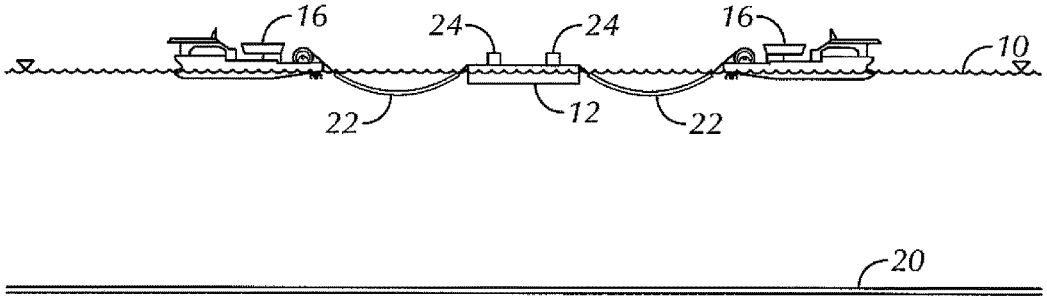
FIG. 6 is a schematic drawing illustrating portions of a method for delivering a subsea equipment package to a sea floor according to embodiments disclosed herein.

Next, at least one other vessel 16 (i.e. tugs or other offshore workboats), each fitted with winch and sufficient heavy weighted catenary cable (i.e. anchor chain) 22 with sufficient strength and length, attach their cable assemblies to the massive object being installed. For the purpose of this description, two vessels 16 will be used to illustrate the disclosure although any number of vessels or tugs are possible to use, see FIG. 6.

Prior to the offshore operation, an installation analysis will have been performed using the properties of the massive object (i.e. weight, buoyancy, submerged weight, etc.), the weighted catenary cable properties (i.e. weight per foot, submerged weight, etc.), the connecting cable properties (i.e. total deployed length, weight per foot, submerged weight, etc.), the massive object's buoyancy properties (i.e. dry weight, submerged lift, ballasting volumes, etc.), and installation sea conditions.

Figure 7:
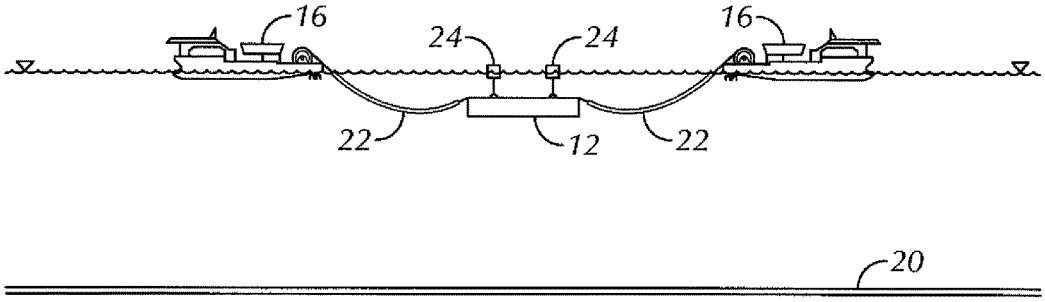
FIG. 7 is a schematic drawing illustrating portions of a method for delivering a subsea equipment package to a sea floor according to embodiments disclosed herein.
Figure 8:
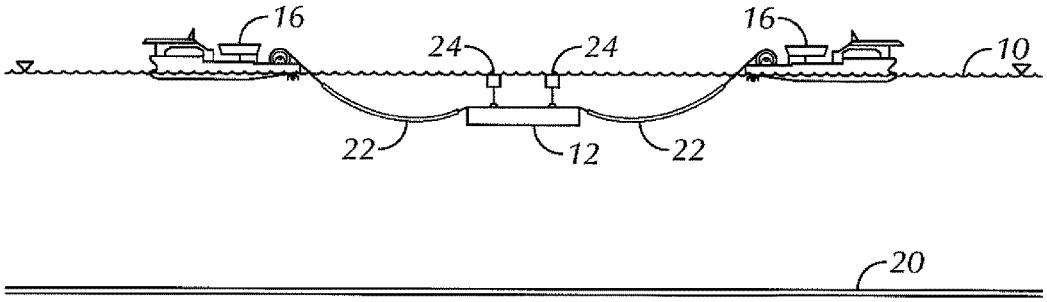
FIG. 8 is a schematic drawing illustrating portions of a method for delivering a subsea equipment package to a sea floor according to embodiments disclosed herein.
Figure 9:
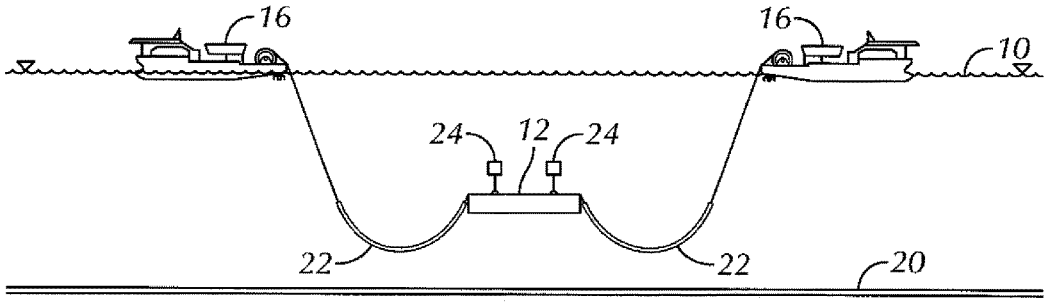
FIG. 9 is a schematic drawing illustrating portions of a method for delivering a subsea equipment package to a sea floor according to embodiments disclosed herein.

After the vessels 16 attach their weighted catenary cables 22 to the opposite ends of the massive floating object 12 to be installed on the seafloor 20, each vessel pays out the required weighted catenary cable length while the object is maintained in the desired location. The two vessels and the massive object are aligned along a common axis (180 degrees apart). Installations using multiple vessels may be equidistantly arrayed around the object (such as 3 vessels at 120 degrees or 4 vessels at 90 degrees to each other). Once properly aligned, the massive floating object will be ballasted below the surface 10, see FIG. 7. The attached buoyancy (temporary floatation device) 24 will act to maintain a net positive vertical force on the massive object 12. During the deployment of more weighted catenary cable 22, vertical buoyant force of the massive object will be overcome by the weight of the catenaries, see FIG. 8. Once the massive object is submerged, it will be suspended in equilibrium. The vertical location of the massive object will be regulated completely by the shape and location of the catenaries. Because of this, the deployment vessel motions will be de-coupled from the massive object by the catenaries. The vessels will use a combination of down-line payout, heading, and propulsion which may in some cases be assisted with ROVs to manage the descent rate and positioning of the massive object, see FIG. 9.

Figure 10:
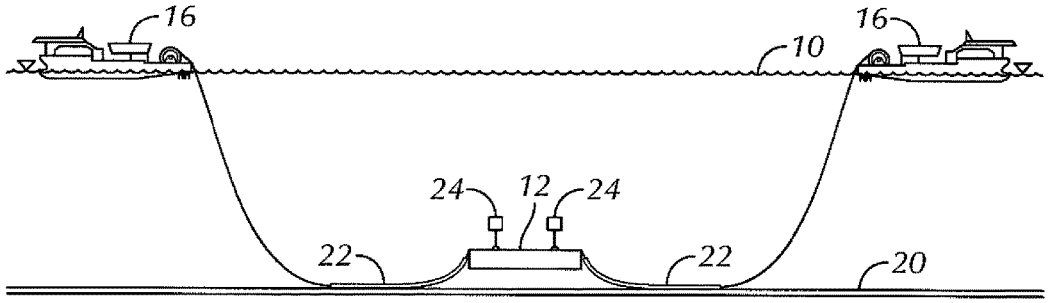
FIG. 10 is a schematic drawing illustrating portions of a method for delivering a subsea equipment package to a sea floor according to embodiments disclosed herein.
Figure 11:
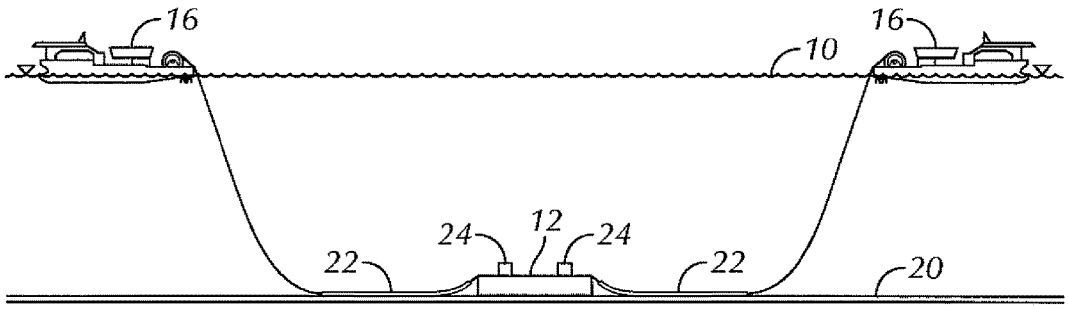
FIG. 11 is a schematic drawing illustrating portions of a method for delivering a subsea equipment package to a sea floor according to embodiments disclosed herein.

Once the massive object has been successfully lowered to the target location, the vertical buoyant force of the attached buoyancy 24 may prevent the massive object from completely landing on the seafloor 20, see FIG. 10. The attached buoyancy will be either disconnected or de-ballasted (with an ROV for example) to complete the landing operation, see FIG. 11.

This installation process is reversible if the object is equipped with buoyancy tanks that can be de-ballasted and re-ballasted. To recover, the buoyancy could be de-ballasted with compressed air (or gases). The de-ballasted attached buoyancy would slowly lift the massive object from the seafloor. The vessels would then lift the weighted catenaries from the seafloor and the massive object would again move to a submerged equilibrium point. The vessels would recover the down-line and weighted catenary cables to bring the massive object to the surface. Once near the surface, the massive object could be further de-ballasted for towing back to port.

The process for lowering and/or recovering an object, or equipment of a large size and mass, to the seafloor according to this method, may be accomplished by a series of steps.

First, the object to be lowered is initially floating on the surface of the sea using integral buoyancy, temporary buoyancy, or support from a workboat or launch barge. Multiple vessels (tugs, anchor handlers or workboats) equipped with winches and weighted cables are attached to the perimeter of the object being installed The equipment package is lowered (or ballasted) to bring the object just below the surface such that the attached buoyancy maintains net positive buoyancy. Each vessel then pays out a predetermined amount of weighted cable to overcome the attached buoyancy and submerge the object. In this manner the package will be deployed close to the seafloor by both vessels continuing to payout their supporting cables. Finally, the equipment package will be landed on the seafloor by either removing or ballasting the attached buoyancy of the object Large subsea packages may be constructed with a barge-like structure having a central area that contains several thousand barrels of chemical storage in flexible bladders or tanks, such as identified in U.S. Pat. No. 9,079,639 and U.S. Patent Application Publication No. 2014/0341657, both incorporated herein by reference. The barge-like structure may support a large payload, for example 600 tons of chemicals that are lowered and positioned on the seafloor in a controlled manner using the methods described herein. An arrangement of buoyancy tanks may be incorporated into the barge-like structure, such that when the buoyancy tank is empty (air filled), the entire structure and payload is able to float on the surface of the water similar to a barge. When this buoyancy tank is water filled, the volume of fixed buoyancy limits the apparent underwater weight such that the hoisting equipment would support the entire structure as the payload transits to or from the water surface and the seafloor.

This ability to safely transit large payloads from the surface to the seafloor represents a unique and useful method for placing and recovering other large payloads on the seafloor. The payloads may be any combination of equipment, process equipment, drilling/completions fluids and equipment, pipeline or other construction/decommissioning equipment needed at the seafloor. The deployment may be temporary or semi-permanent depending upon the payload and its function on the seafloor.

Several unique aspects and devices are described in this application that allow the lowering and positioning of these large structures and their payloads onto the seafloor in a viable and safe operation.

Figure 12:
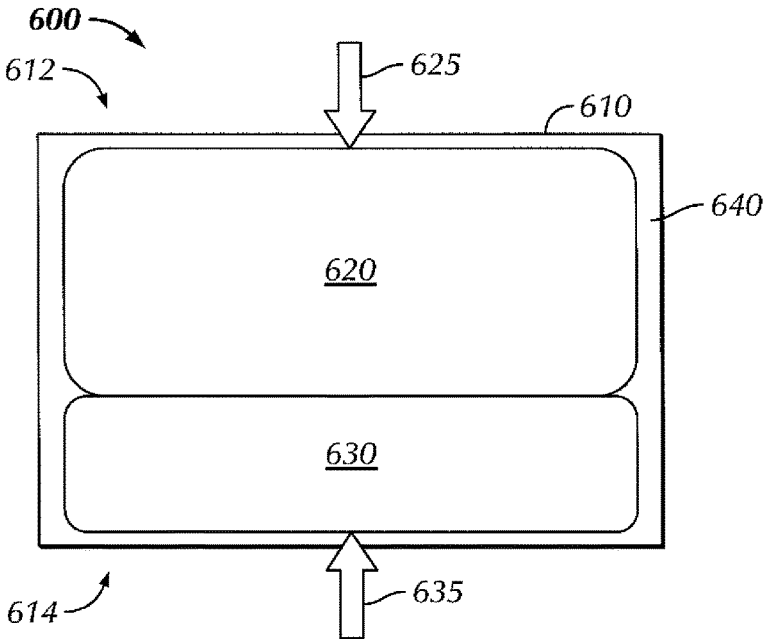
FIG. 12 is an illustration of a tank which may be installed as part of the subsea equipment package according to embodiments disclosed herein.

According to embodiments of the present disclosure, a structure may have at least one liquid storage tank and at least one buoyancy tank, such as described in U.S. Patent Application Publication No. 2014/0341657. FIG. 12 shows an example of a liquid storage tank useful with embodiments of the present disclosure. The storage tank 600 has a rigid outer container 610 and at least two flexible inner containers 620, 630. The inner containers 620, 630 may be, for example, bladders made of a flexible, durable material suitable for storing liquids in a subsea environment, such as polyvinyl chloride ("PVC") coated fabrics, ethylene vinyl acetate ("EVA") coated fabrics, or other polymer composites. The inner containers include a first inner container 630 containing seawater and a second inner container 620 containing at least one stored liquid. Depending upon the specific gravity of the stored liquid, these may be reversed. The inner containers are pressure balanced such that as the stored liquid is added or removed from the second inner container 620, a corresponding volume of seawater may outflow or inflow from the first inner container 630. The inner containers 620, 630 may be equipped with closure valves that close and seal-off when the associated inner container fully collapses, which may protect the integrity of the inner containers by not subjecting the inner containers to potentially large differential pressures. Further, while the volumes of the at least two inner containers are variable, the volume of the outer container 610 remains fixed. The outer container 610 may act as an integral secondary or backup containment vessel that would contain any leak from the inner containers, thus creating a pressure balanced dual barrier containment system. As used herein, a "dual barrier" system refers to a system where both an inner container and an outer container have to fail before there is a tank content leak or discharge to the sea environment. Monitoring of the conditions in the space 640 between the dual barriers may provide an indication of required repairs for a failure of a primary barrier (an inner container).

Further, the volume of the outer container 610 remains fixed, and the volumes of the at least two inner containers 620, 630 are variable. For example, while the stored liquid may be added or removed from the second inner container 620 through a controlled opening 625 (and increase or decrease the respective volume of the second inner container 620) and a corresponding volume of seawater may outflow or inflow from the first inner container 630 through a controlled opening 635 (and decrease or increase the respective volume of the first inner container 630), the size and volume of the rigid outer container 610 remains fixed. A barrier fluid may be disposed between the annular space 640 between the outer container 610 and the inner containers 620, 630. The barrier fluid may be monitored for contamination, such as contamination from a leak in one of the inner containers. For example, the barrier fluid may be monitored by disposing sensors within the annular space 640 between the outer container 610 and the inner containers 620, 630, or barrier fluid samples may be periodically collected and analyzed on a periodic basis. According to embodiments of the present disclosure, a storage tank may include at least one sensor disposed in the space between the outer container and the at least two inner containers. Sensors may be used in the storage tank, for example, to monitor contamination of the barrier fluid, as discussed above, to monitor the volumes of the at least two inner containers, to monitor temperature and/or pressure conditions, or to monitor other conditions of the storage tank.

The active volume of fluid in each inner container may be monitored by measuring the inner container's relative location to either the topside 612 or bottom side 614 of the outer container 610. As used herein, "topside" may refer to the side of the referenced component that faces the seawater surface when the component is installed at the sea floor, and "bottom side" may refer to the side of the referenced component that faces the sea floor when the component is installed at the sea floor. In some embodiments, monitoring the active volume of each inner container may be achieved by monitoring the inflow and outflow of the respective inner containers, which may help assure integrity of the storage system as well as provide an indication of the chemical dosing performed from the storage system.

The structure having at least one storage tank and at least one buoyancy tank may be used for payload deployment and recovery, and may also be used as a seafloor foundation for processing and equipment. This foundation may enable the pre-deployment assembly, testing and commissioning of such payloads.

The barge-like structure may act as a structural foundation for the support and operation of various seafloor equipment or other payload. It is possible that the entire package of equipment may be tested and commissioned on the surface prior to its deployment to the seafloor. The unique deployment capability incorporates an integrated payload foundation to improve reliability of the equipment, minimize seafloor based construction and provide an effective and efficient recovery method should the equipment malfunction or need to be recovered for repairs, maintenance or modification.

An aspect of the buoyancy tank is to limit the maximum hoisting wire load as the entire structure and payload transit from the sea surface to and from the seafloor. This buoyancy tank may be either static or dynamic in nature.

According to embodiments of present disclosure, a method of transporting payloads between a sea surface and a seafloor may include using a structure having at least one buoyancy tank, such as described above, and changing a volume of buoyancy material within the at least one buoyancy tank to support the payload. For example, the structure may be lowered to the seafloor, wherein compressing the volume of buoyancy material within the at least one buoyancy tank includes adding at least a portion of the buoyancy material to the at least one buoyancy tank. In another example, the structure may be lifted from the seafloor, wherein expansion of the volume of buoyancy material within the at least one buoyancy tank includes releasing buoyancy material from the at least one buoyancy tank. The buoyancy material may be, for example, at least one of air, nitrogen and spheres of buoyant material ranging in size from fine powder to large spheres. In some embodiments, changing the volume of buoyancy material may include filling the at least one buoyancy tank with loose buoyancy materials through the use of water-buoyancy material slurry. For example, the water-buoyancy material slurry may be added to or removed from the at least one buoyancy tank with a slurry lift pump.

In some embodiments, a structure used to transport payloads between a sea surface and seafloor may have at least one liquid storage container and at least one buoyancy tank with an open bottom buoyancy tank, wherein the open bottom buoyancy tank has at least one vent hole along a side of the open bottom buoyancy tank. The volume of buoyancy material within the at least one buoyancy tank may be changed by closing the at least one vent hole at a near surface depth.

Further, in some embodiments, a method of transporting a payload may include pulling a structure having at least one liquid storage container and at least one buoyancy tank with a surface support vessel.

Further, the barge-like structure may be fitted with piping and compartments to house and protect the chemical injection pump and meter components that route the chemicals (or other liquid other than seawater) through high pressure hoses or tubes to their injection points. In some embodiments, the injection pump and related components located on the barge-like structure with the storage tank may be de-ballasted, returned to the sea-surface, and transported to shore, and thus may be routinely maintained along with the storage tank. In some embodiments, the injection pump and metering components may be separately located on a module-like structure that is independently maintained.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for lowering a subsea equipment package to the seafloor, the process comprising:

towing the subsea equipment package to sea, via one or more vessels, on a sea surface;

attaching a plurality of vessels via cable and weighted line to corresponding landing points of the subsea equipment package;

paying out an amount of the cables from the plurality of vessels;

tensioning the cables forming a catenary shape in the weighted line;

adjusting a length of the weighted catenary cable such that a vertical buoyant force of the subsea equipment package will be overcome by the weight of the weighted line causing the subsea equipment package to sink while maintaining the catenary shape;

controlling a position of the subsea equipment package as the subsea equipment package is lowered toward a sea floor;

landing the subsea equipment package directly on the sea floor.

2. The process of claim 1, wherein the plurality of vessels comprises two or more vessels, each attaching to a single, respective, landing point of the subsea equipment package.

3. The process of claim 1, wherein adjusting a buoyancy of the subsea equipment package comprises one or more of:

ballasting the subsea equipment package;

deballasting the subsea equipment package;

removing buoyancy from the subsea equipment package;

adding buoyancy to the subsea equipment package, launching the subsea equipment package from a support vessel;

adding the weighted line to apply a downward force to the subsea equipment package.

4. The process of claim 1, wherein the controlling a position of the subsea equipment package comprises one or more of;

adjusting a length of the cables deployed from one or more of the plurality of vessels;

adjusting a position or thrust/propulsion of one or more of the plurality of vessels;

adjusting an amount of ballast of the subsea equipment package;

adjusting an amount of weighted line deployed from one or more of the plurality of vessels.

5. The process of claim 1, wherein the subsea equipment package maintains a net positive buoyancy during the sinking process.

6. The process of claim 1, wherein the paying out, adjusting, and controlling is configured to minimize a natural frequency resonance effect during the sinking process.

7. The process of claim 1, wherein the paying out, adjusting, and controlling is configured to minimize the tension on the cables during the sinking process.

8. The process of claim 1, wherein the paying out, adjusting, and controlling is configured to decouple the motion of the subsea equipment package as it sinks from the motion of the plurality of vessels at the surface.

9. The process of claim 1, further comprising recovering and reusing one or more of the cables, a buoyancy material, and the ballast.

10. The process of claim 1, further comprising recovering the subsea equipment package from the seafloor.

11. The process of claim 1, wherein the subsea equipment package comprises one or more of:

a. mechanical equipment for processing fluids on the seafloor;

b. mechanical equipment for construction services of wells, pipelines, or facilities;

c. supplies required for support of above mechanical equipment;

d. tanks for storage of liquids, such as production chemicals, dispersants, mud, or liquid or slurry wastes.

12. A process for lowering a subsea equipment package to the seafloor, the process comprising:

towing the subsea equipment package to sea, via one or more vessels, on a sea surface;

attaching a plurality of vessels via cable and weighted line to corresponding landing points of the subsea equipment package;

paying out an amount of the cables from the plurality of vessels to increase the overall system compliance to vessel motion;

tensioning the cables forming a catenary shape in the weighted line;

decreasing buoyancy of the subsea equipment package to lower the subsea equipment package to below the sea surface;

controlling the vessel position, spacing, thrust, and catenary shape on the subsea equipment package to maintain system compliance as the subsea equipment package is lowered toward the sea floor;

positioning the subsea equipment package on the sea floor.

13. The process of claim 12, wherein the plurality of vessels comprises two or more vessels, each attaching to a single, respective, landing point of the subsea equipment package.

14. The process of claim 12, wherein adjusting a buoyancy of the subsea equipment package comprises one or more of:

ballasting the subsea equipment package;

de-ballasting the subsea equipment package;

removing buoyancy from the subsea equipment package;

adding buoyancy to the subsea equipment package, launching the subsea equipment package from a support vessel;

adding the weighted line to apply a downward force to the subsea equipment package.

15. The process of claim 12, further comprising controlling a position of the subsea equipment package, the process comprising one or more of:

adjusting a length of the cables deployed from one or more of the plurality of vessels;

adjusting the position or thrust/propulsion of one or more of the plurality of vessels;

adjusting an amount of ballast of the subsea equipment package.

16. The process of claim 12, wherein the paying out, adjusting, and controlling is configured to minimize a natural frequency resonance effect during the sinking process.

17. The process of claim 12, wherein the paying out, adjusting, and controlling is configured to minimize the tension on the cables during the sinking process.

18. The process of claim 12, wherein the paying out, adjusting, and controlling is configured to decouple the motion of the subsea equipment package as it sinks from the motion of the plurality of vessels at the surface.

19. The process of claim 12, wherein the subsea equipment package is recovered via a process comprising one or more of:

paying out an amount of the cables from the plurality of vessels;

re-attaching the plurality of vessels via cables to corresponding landing points of the subsea equipment package;

increasing the cable tension of the subsea equipment package to lift the subsea equipment package off the sea floor;

increasing the buoyancy of the subsea equipment package to lift the subsea equipment package to the sea surface;

reeling in the cables from the plurality of surface vessels.

20. The process of claim 12, wherein the subsea equipment package is positively buoyant prior to decreasing the buoyancy of the subsea equipment package.

21. A process for lowering a positively buoyant subsea equipment package to the seafloor, the process comprising:

towing the subsea equipment package to sea, via one or more vessels, on a sea surface;

attaching a plurality of vessels via cables and weighted line to corresponding landing points of the positively buoyant subsea equipment package;

paying out an amount of a linear, or non-linear, weighted line from the plurality of vessels to overcome the residual subsea equipment package buoyancy and increase the overall system compliance to vessel motions;

adjusting buoyancy or ballast of the subsea equipment package to partial sink the subsea equipment package;

controlling a vessel position, spacing, thrust, and cable tension on the subsea equipment package to maintain system compliance as the subsea equipment package is lowered toward the sea floor;

completely landing the subsea equipment package on the sea floor.

22. The process of claim 21, wherein the plurality of vessels comprises two or more vessels, each attaching to a single, respective, landing point on the subsea equipment package.

23. The process of claim 21, wherein adjusting buoyancy of the subsea equipment package comprises one or more of:

ballasting the subsea equipment package;

increasing the buoyancy of the subsea equipment package; or adding additional weighted line to apply a downward force to the subsea equipment package.

24. The process of claim 21, further comprising controlling a position of the subsea equipment package, the process comprising one or more of:

adjusting a length of lift cable deployed from one or more of the plurality of vessels;

adjusting a position or thrust/propulsion of one or more of the plurality of vessels;

decreasing an amount of ballast of the subsea equipment package;

increasing an amount of weighted line deployed from one or more of the plurality of vessels.

25. The process of claim 21, wherein the paying out, adjusting, and controlling is configured to minimize a natural frequency resonance effect during the sinking process.

26. The process of claim 21, wherein the paying out, adjusting, and controlling is configured to minimize the tension on the cables during the sinking process.

27. The process of claim 21, wherein the paying out, adjusting, and controlling is configured to decouple the motion of the subsea equipment package as it sinks from the motion of the plurality of vessels at the surface.

28. The process of claim 21, wherein the subsea equipment package is recovered via a process comprising one or more of:

paying out an amount the cables from the plurality of vessels;

re-attaching a plurality of vessels via cables to corresponding landing points of the subsea equipment package;

increasing the cable tension on the subsea equipment package to lift the subsea equipment package off the sea floor;

increasing the buoyancy of the subsea equipment package to lift the subsea equipment package to the sea surface;

de-ballasting the subsea equipment package;

reeling in the cables from the plurality of surface vessels.

* * * * *